US006931870B2

(12) United States Patent
Kim et al.

(10) Patent No.: US 6,931,870 B2
(45) Date of Patent: Aug. 23, 2005

(54) TIME DIVISION MULTI-CYCLE TYPE COOLING APPARATUS AND METHOD FOR CONTROLLING THE SAME

(75) Inventors: Yoon-Young Kim, Suwon (KR); Hak-Gyun Bae, Andong (KR); Chang-Nyeun Kim, Seoul (KR); Jae-Seung Lee, Hwasung (KR); Myung-Wouk Kim, Kwangju (KR); Eung-Ryeol Seo, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/633,587

(22) Filed: Aug. 5, 2003

(65) Prior Publication Data

US 2004/0107727 A1 Jun. 10, 2004

(30) Foreign Application Priority Data

Dec. 4, 2002 (KR) ..... 10-2002-0076636
Feb. 10, 2003 (KR) ..... 10-2003-0008174
Mar. 19, 2003 (KR) ..... 10-2003-0017221

(51) Int. Cl.[7] ..... F25B 49/02
(52) U.S. Cl. ..... 62/198; 62/504
(58) Field of Search ..... 62/197, 198, 504, 62/524, 525, 441

(56) References Cited

U.S. PATENT DOCUMENTS 3,984,224 A * 10/1976 Dawkins ..... 62/89
4,499,738 A * 2/1985 Motoyama et al. ..... 62/155
4,637,219 A * 1/1987 Grose ..... 62/199
4,646,537 A * 3/1987 Crawford ..... 62/238.6
4,771,610 A * 9/1988 Nakashima et al. ..... 62/160
5,103,650 A * 4/1992 Jaster ..... 62/198
5,228,308 A * 7/1993 Day et al. ..... 62/198
5,231,847 A * 8/1993 Cur et al. ..... 62/187
5,370,307 A * 12/1994 Uehra ..... 237/2 B
6,295,825 B1 * 10/2001 Jin ..... 62/238.7
6,672,089 B2 * 1/2004 Park et al. ..... 62/199

* cited by examiner

*Primary Examiner*—William E. Tapolcai
(74) *Attorney, Agent, or Firm*—Staas & Halsey LLP

(57) ABSTRACT

The present invention relates to a cooling apparatus including a compressor, a condenser, a first expanding unit, a second expanding unit, a third expanding unit, a first evaporator, and a second evaporator; a first refrigerant circuit containing refrigerant discharged from the compressor and flowing into a suction side of the compressor through the condenser, the first expanding unit, the first evaporator, the second expanding unit and the second evaporator; a second refrigerant circuit containing the refrigerant passing through the condenser flowing into the suction side of the compressor through the third expanding unit and the second evaporator; a flow path control unit installed at a discharge side of the condenser, switching a refrigerant flow path so that the refrigerant passing through the condenser flows through at least one of the first and second refrigerant circuits; and a control unit selectively opening and closing the flow path control unit. The invention also relates to a method for controlling the apparatus.

28 Claims, 9 Drawing Sheets

ENTIRE COOLING MODE
FREEZER COMPARTMENT COOLING MODE
t1
FIG. 4A : COMPRESSOR
ON
OFF
FIG. 4B : FREEZER COMPARTMENT FAN
ON
OFF
FIG. 4C : REFRIGERATOR COMPARTMENT FAN
ON
OFF
FIG. 4D : FIRST VALVE (210a)
OPEN
CLOSE
FIG. 4E : SECOND VALVE (210b)
OPEN
CLOSE

FIG. 5A : COMPRESSOR
ON
OFF
FIG. 5B : FREEZER COMPARTMENT FAN
ON
OFF
FIG. 5C : REFRIGERATOR COMPARTMENT FAN
ON
OFF
t2
t3
FIG. 5D : FIRST VALVE (210a)
OPEN
CLOSE
FIG. 5E : SECOND VALVE (210b)
OPEN
CLOSE
FIG. 5F : DEFROST HEATER (104a)
ON
OFF

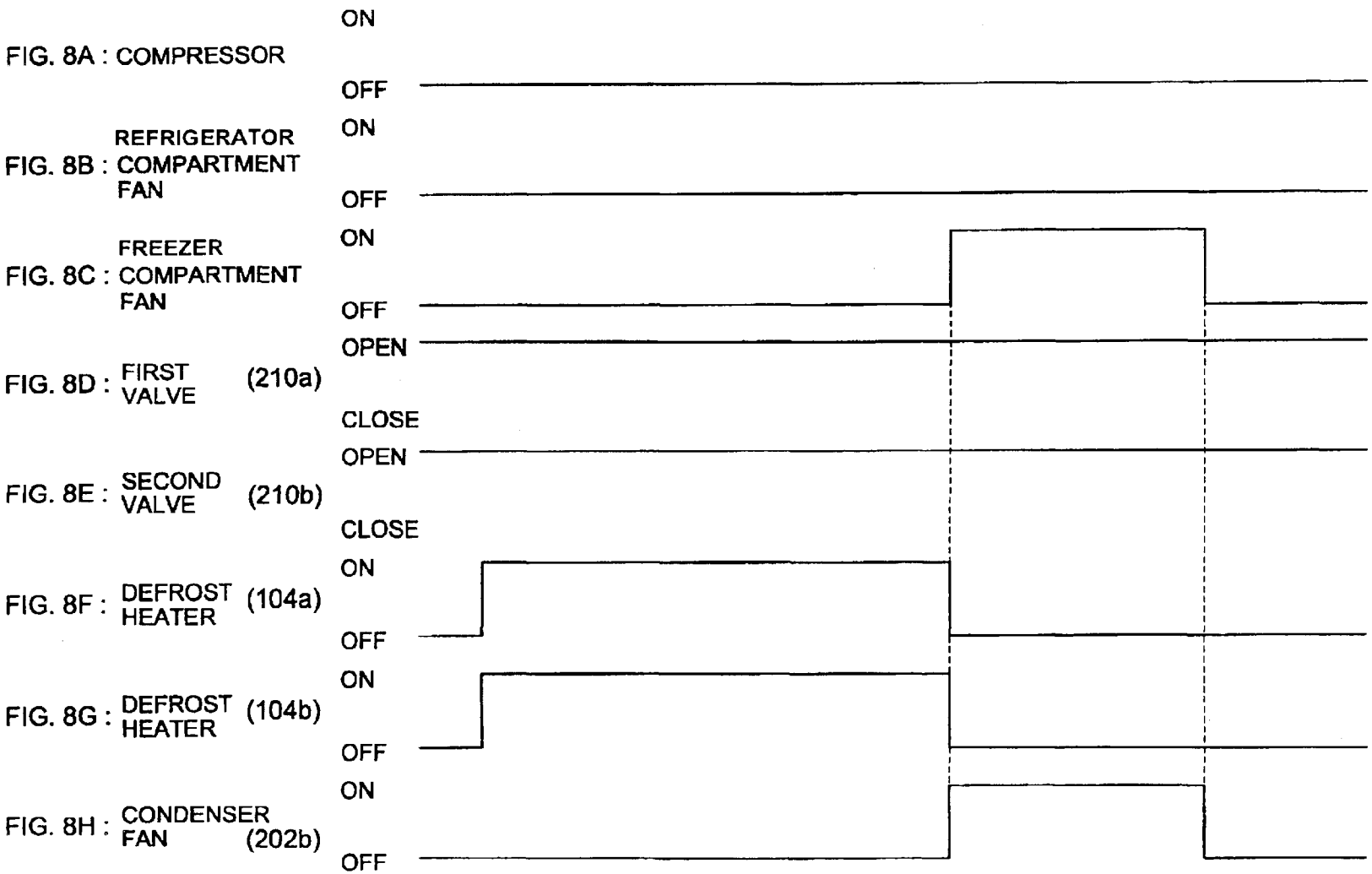
FIG. 8A : COMPRESSOR
ON
OFF
FIG. 8B : REFRIGERATOR COMPARTMENT FAN
ON
OFF
FIG. 8C : FREEZER COMPARTMENT FAN
ON
OFF
FIG. 8D : FIRST VALVE (210a)
OPEN
CLOSE
FIG. 8E : SECOND VALVE (210b)
OPEN
CLOSE
FIG. 8F : DEFROST HEATER (104a)
ON
OFF
FIG. 8G : DEFROST HEATER (104b)
ON
OFF
FIG. 8H : CONDENSER FAN (202b)
ON
OFF

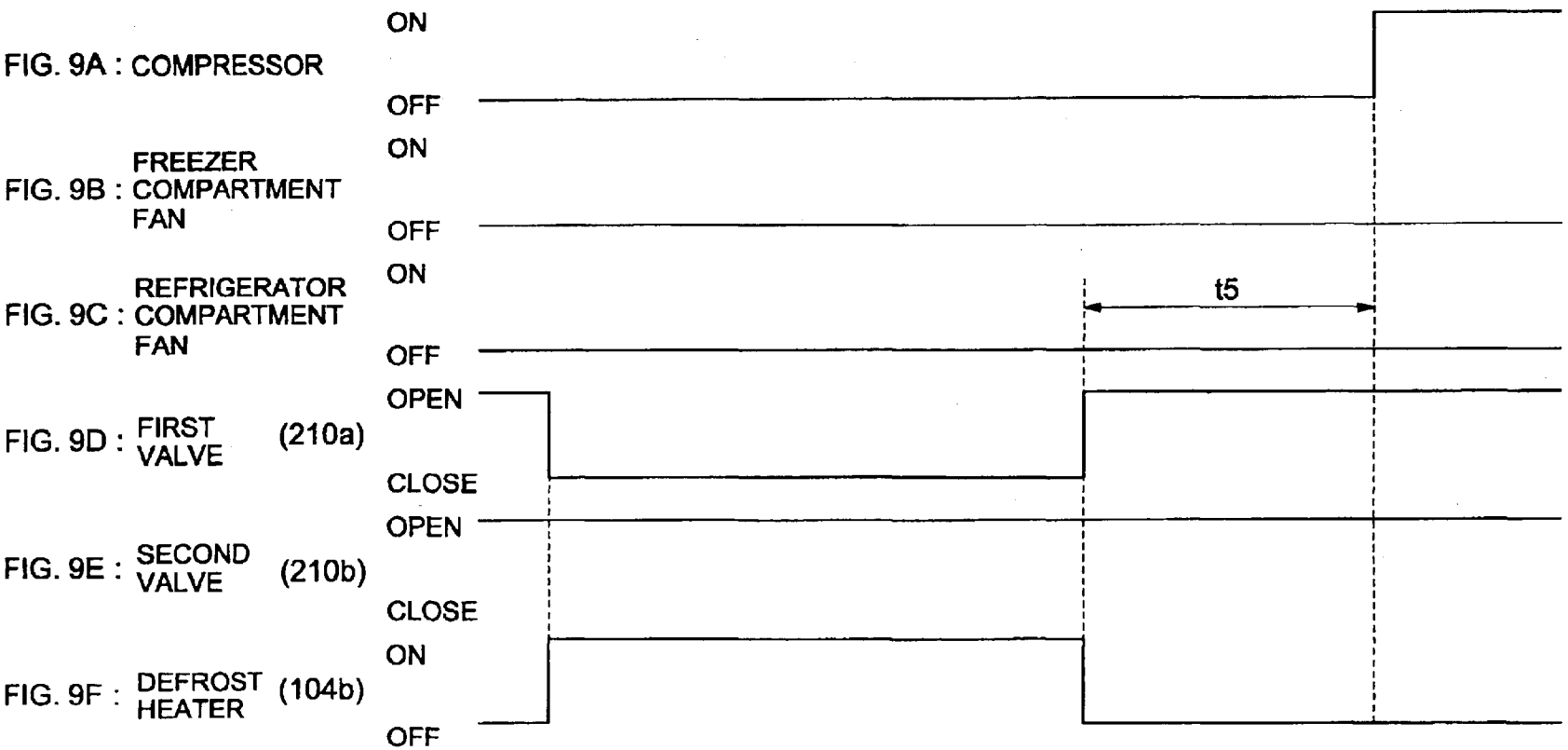
FIG. 9A : COMPRESSOR
ON
OFF
FIG. 9B : FREEZER COMPARTMENT FAN
ON
OFF
FIG. 9C : REFRIGERATOR COMPARTMENT FAN
ON
OFF
FIG. 9D : FIRST VALVE (210a)
OPEN
CLOSE
FIG. 9E : SECOND VALVE (210b)
OPEN
CLOSE
FIG. 9F : DEFROST HEATER (104b)
ON
OFF
t5

TIME DIVISION MULTI-CYCLE TYPE COOLING APPARATUS AND METHOD FOR CONTROLLING THE SAME

CROSS-REFERENCE TO RELATED APPLICATIONS

This application claims the benefit of Korean Patent Application No. 2002-76636, filed Dec. 4, 2002, Korean Patent Application No. 2003-8174, filed Feb. 10, 2003, and Korean Patent Application No. 2003-17221, filed Mar. 19, 2003, in the Korean Intellectual Property Office, the disclosures of which are incorporated herein by reference.

BACKGROUND OF THE INVENTION

1. Field of the Invention

The present invention relates, in general, to a cooling apparatus, and, more particularly, to a cooling apparatus which has two or more independently cooled cooling compartments.

2. Description of the Related Art

Generally, in a cooling apparatus having two or more cooling compartments, respective cooling compartments are separated by partition walls, and selectively opened and closed by doors. Further, an evaporator, which generates cool air, and a fan, which blows the cool air into each of the cooling compartments, are mounted in each cooling compartment. Since all cooling compartments are independently cooled by the operation of respective evaporators and fans, this cooling manner is called an independent cooling manner.

As a representative cooling apparatus to which the independent cooling manner is applied, there is a refrigerator with a freezer compartment and a refrigerator compartment. The freezer compartment of the refrigerator is generally used to keep frozen food, and a typical suitable temperature thereof is approximately −18° C. The refrigerator compartment is used to keep normal food, not requiring freezing, at the normal temperature equal to or greater than 0° C. A typical suitable temperature in the refrigerator compartment is approximately 3° C.

Although the suitable temperatures of the refrigerator and freezer compartments are different, as described above, evaporation temperatures of refrigerator and freezer compartment evaporators are the same in a conventional refrigerator. Therefore, a freezer compartment fan is continuously operated, and a refrigerator compartment fan is intermittently operated to blow cool air into the refrigerator compartment if necessary, thus preventing the internal temperature of the refrigerator compartment from excessively decreasing.

As described above, even though the evaporation of refrigerant is continuously carried out in the refrigerator compartment evaporator, the operation of the refrigerator compartment fan is intermittently carried out, so cool air generated during an idle period of the refrigerator compartment fan is not supplied to the refrigerator compartment, but becomes a factor in forming frost on a surface of the refrigerator compartment evaporator. As frost is formed on the surface of the refrigerator compartment evaporator, evaporation efficiency of the refrigerator compartment evaporator deteriorates, thus deteriorating cooling efficiency of the refrigerator compartment. Further, even under conditions where cooling of only the refrigerator compartment is required, refrigerant must be compressed in consideration of an evaporation temperature required for the freezer compartment evaporator, thus unnecessarily increasing a load of the compressor.

SUMMARY OF THE INVENTION

Accordingly, it is an aspect of the present invention to provide a time division multi-cycle type cooling apparatus, and a method of controlling the same, which may optimize temperatures of freezer and refrigerator compartments by controlling cooling operations of the refrigerator and the freezer compartments according to controlled a time intervals.

Additional aspects and advantages of the invention will be set forth in part in the description which follows and, in part, will be obvious from the description, or may be learned by practice of the invention.

The foregoing and/or other aspects of the present invention are achieved by providing a cooling apparatus including a compressor, a condenser, a first expanding unit, a second expanding unit, a third expanding unit, a first evaporator, a second evaporator, first and second refrigerant circuits, a flow path control unit, and a control unit. The first refrigerant circuit contains refrigerant discharged from the compressor flowing into a suction side of the compressor through the condenser, the first expanding unit, the first evaporator, the second expanding unit and the second evaporator. The second refrigerant circuit contains the refrigerant passing through the condenser flowing into the suction side of the compressor through the third expanding unit and the second evaporator. The flow path control unit is installed at a discharge side of the condenser switching a refrigerant flow path so that the refrigerant passing through the condenser flows through at least one of the first and second refrigerant circuits. The control unit selectively opens and closes the flow path control unit.

BRIEF DESCRIPTION OF THE DRAWINGS

These and/or other aspects and advantages of the invention will become apparent and more readily appreciated from the following description of the preferred embodiments, taken in conjunction with the accompanying drawings of which:

FIGS. 8A–8H include timing charts showing a defrosting control operation of refrigerator and freezer compartment evaporators, with re-start of a compressor taken into consideration, in the refrigerator, according to an embodiment of the present invention; and FIGS. 9A–9F include timing charts showing an independent defrosting control operation of only the freezer compartment evaporator of the refrigerator, according to an embodiment of the present invention.

DETAILED DESCRIPTION OF THE PREFERRED EMBODIMENTS

Figure 1:
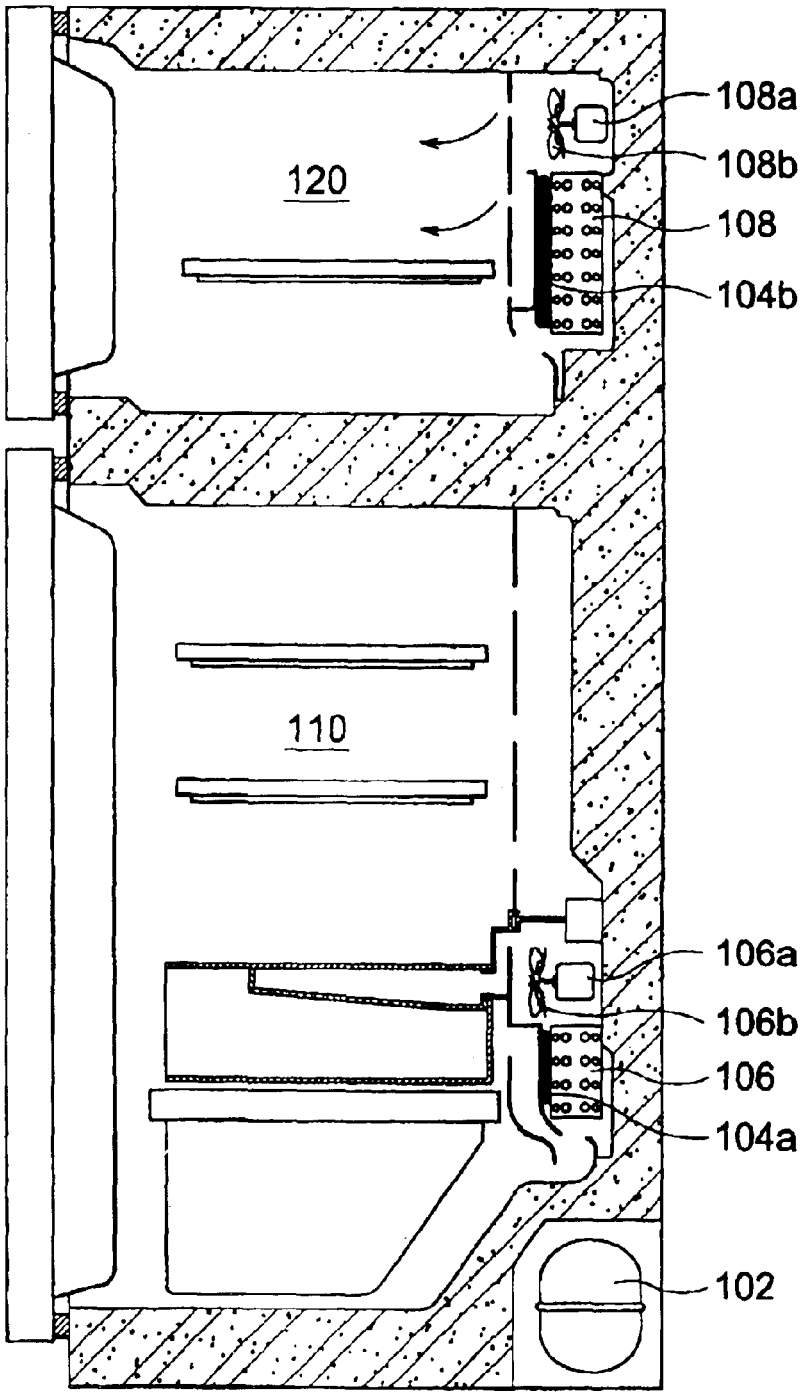
FIG. 1 is a side sectional view of a refrigerator, according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, a cooling apparatus according to embodiments of the present invention will be described in detail with reference to FIGS. 1 to 9F. FIG. 1 is a side sectional view of a refrigerator according to an embodiment of the present invention. As shown in FIG. 1, a refrigerator compartment evaporator 106, a refrigerator compartment fan motor 106*a*, a refrigerator compartment fan 106*b* and a defrost heater 104*a* are installed in a refrigerator compartment 110. Further, a freezer compartment evaporator 108, a freezer compartment fan motor 108*a*, a freezer compartment fan 108*b* and a defrost heater 104*b* are installed in a freezer compartment 120. The defrost heaters 104*a* and 104*b* are used to eliminate frost formed on surfaces of the refrigerator compartment evaporator 106 and the freezer compartment evaporator 108, respectively.

Cool air generated from the refrigerator compartment evaporator 106 is blown into the refrigerator compartment 110 by the refrigerator compartment fan 106*b*. Cool air generated from the freezer compartment evaporator 108 is blown into the freezer compartment 120 by the freezer compartment fan 108*b*. Additionally, expanding devices (not shown) which depressurize and expand refrigerant are disposed at inlets of both the refrigerator compartment evaporator 106 and the freezer compartment evaporator 108. Further, a condenser (not shown) is disposed at an outlet of the compressor 102.

Figure 2:
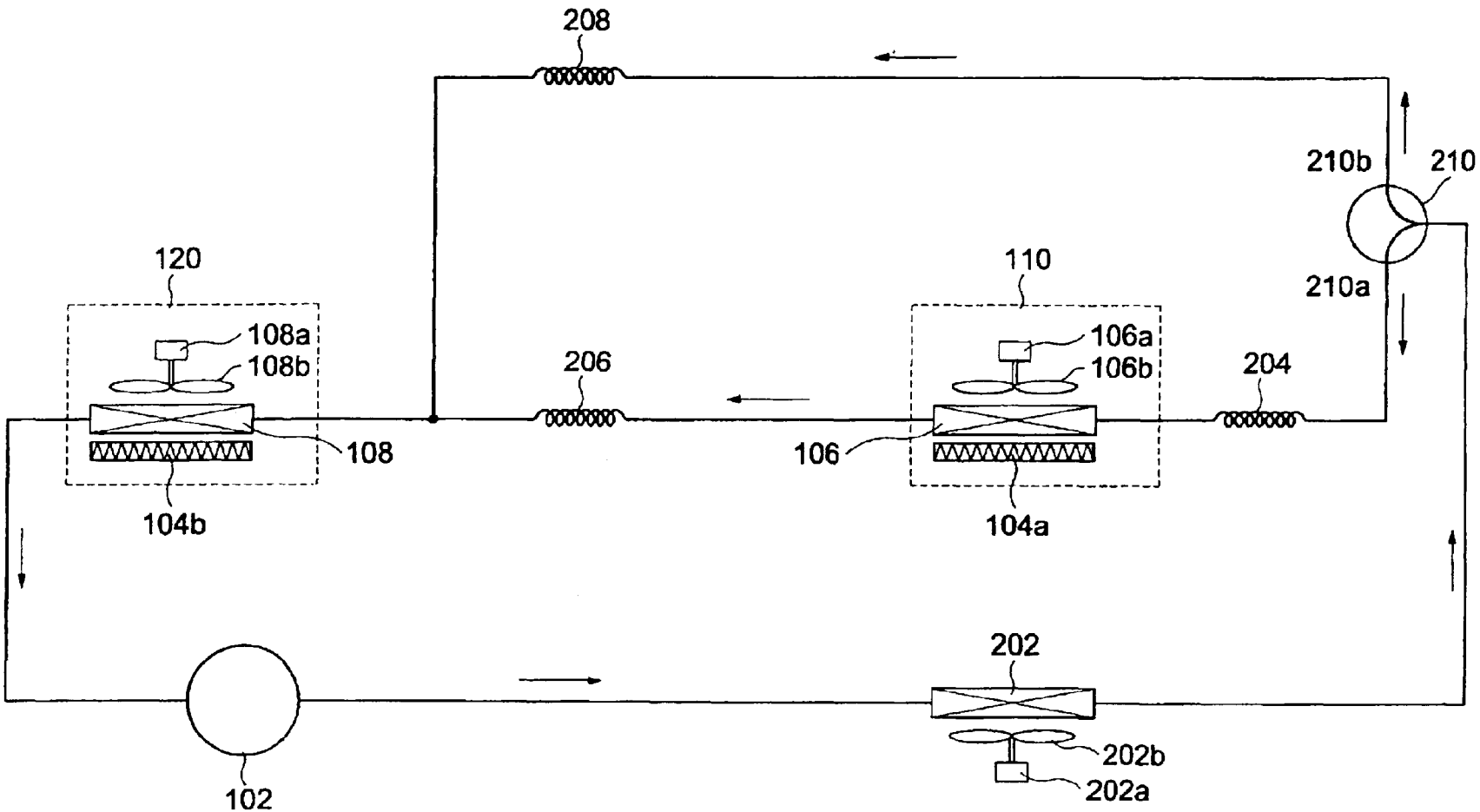
FIG. 2 is a view showing a refrigerant circuit of the refrigerator of FIG. 1.

FIG. 2 is a view showing a refrigerant circuit of the refrigerator of FIG. 1. As shown in FIG. 2, the compressor 102, a condenser 202, a first capillary tube 204, the refrigerator compartment evaporator 106, a second capillary tube 206, and the freezer compartment evaporator 108 are connected to each other through a refrigerant pipe to form a single closed loop refrigerant circuit. Therefore, the refrigerator compartment evaporator 106 and the freezer compartment evaporator 108 are connected to each other through the second capillary tube 206. Further, another closed loop refrigerant circuit passing through a third capillary tube 208 is formed between the condenser 202 and the freezer compartment evaporator 108, so that refrigerant passing through the condenser 202 is depressurized and expanded by the third capillary tube 208 to flow into the freezer compartment evaporator 108. Refrigerant flow control between the two refrigerant circuits is performed through a three-way valve 210 which is a flow path control device. In addition, in the refrigerant circuits of FIG. 2, there are further disposed a condenser fan motor 202*a* which drives a condenser fan 202*b*, the refrigerator compartment fan motor 106*a* which drives the refrigerator compartment fan 106*b*, and the freezer compartment fan motor 108*a* which drives the freezer compartment fan 108*b*.

If the two evaporators 106 and 108 are connected to each other using only a refrigerant pipe having the same inside diameter as that of a refrigerant pipe of a suction side of the compressor 102, evaporation temperatures of the refrigerator compartment evaporator 106 and the freezer compartment evaporator 108 become equal in an entire cooling mode. In this case, if the evaporation temperature of the freezer compartment evaporator 108 is decreased in consideration of cooling of the freezer compartment 120, frost is formed on the surface of the refrigerator compartment evaporator 106. If the evaporation temperature of the freezer compartment evaporator 108 is increased so as to prevent frost from being formed, sufficient cooling of the freezer compartment 120 may not be performed. This problem is solved by connecting the freezer compartment evaporator 108 and the refrigerator compartment evaporator 106 to each other through the second capillary tube 206, as shown in FIG. 2.

The first capillary tube 204 depressurizes refrigerant passing through the condenser 202 to enable the refrigerant to be evaporated at an evaporation temperature required for the refrigerator compartment evaporator 106. The second capillary tube 206 depressurizes the refrigerant passing through the refrigerator compartment evaporator 106 once more to enable the refrigerant to be evaporated at an evaporation temperature required for the freezer compartment evaporator 108. This is because the evaporation temperature required for the freezer compartment evaporator 108 is lower than that required for the refrigerator compartment evaporator 106. The third capillary tube 208 depressurizes the refrigerant passing through the condenser 202 to enable the refrigerant to be evaporated at the evaporation temperature required for the freezer compartment evaporator 108. While the first and second capillary tubes 204 and 206 operate in such a way that the second capillary tube 206 secondarily depressurizes the refrigerant which has been. primarily depressurized by the first capillary tube 204, the third capillary tube 208 directly depressurizes the refrigerant passing through the condenser 202 to such an extent that the refrigerant may be evaporated at the evaporation temperature required for the freezer compartment evaporator 108. For this operation, the third capillary tube 208 is designed so that resistance thereof is greater than that of the second capillary tube 206. Consequently, depressurized degrees of refrigerant through the second and third capillary tubes 206 and 208 must be sufficient to obtain the evaporation temperature required for the freezer compartment evaporator 108. Further, the inside diameter of the second capillary tube 206 is designed to be less than that of the refrigerant pipe of the suction side of the compressor 102 (for example, approximately 2 to 4 mm), so that the refrigerant is depressurized while passing through the second capillary tube 206. If the inside diameter of the second capillary tube 206 is excessively large, the evaporation temperatures of the evaporators 106 and 108 are not greatly different, while if the inside diameter thereof is excessively small, excessively large resistance is generated in a flow of refrigerant, in which liquid and gas are mixed in the refrigerator compartment evaporator 106, thus decreasing a cooling speed of the refrigerator compartment 110.

Figure 3:
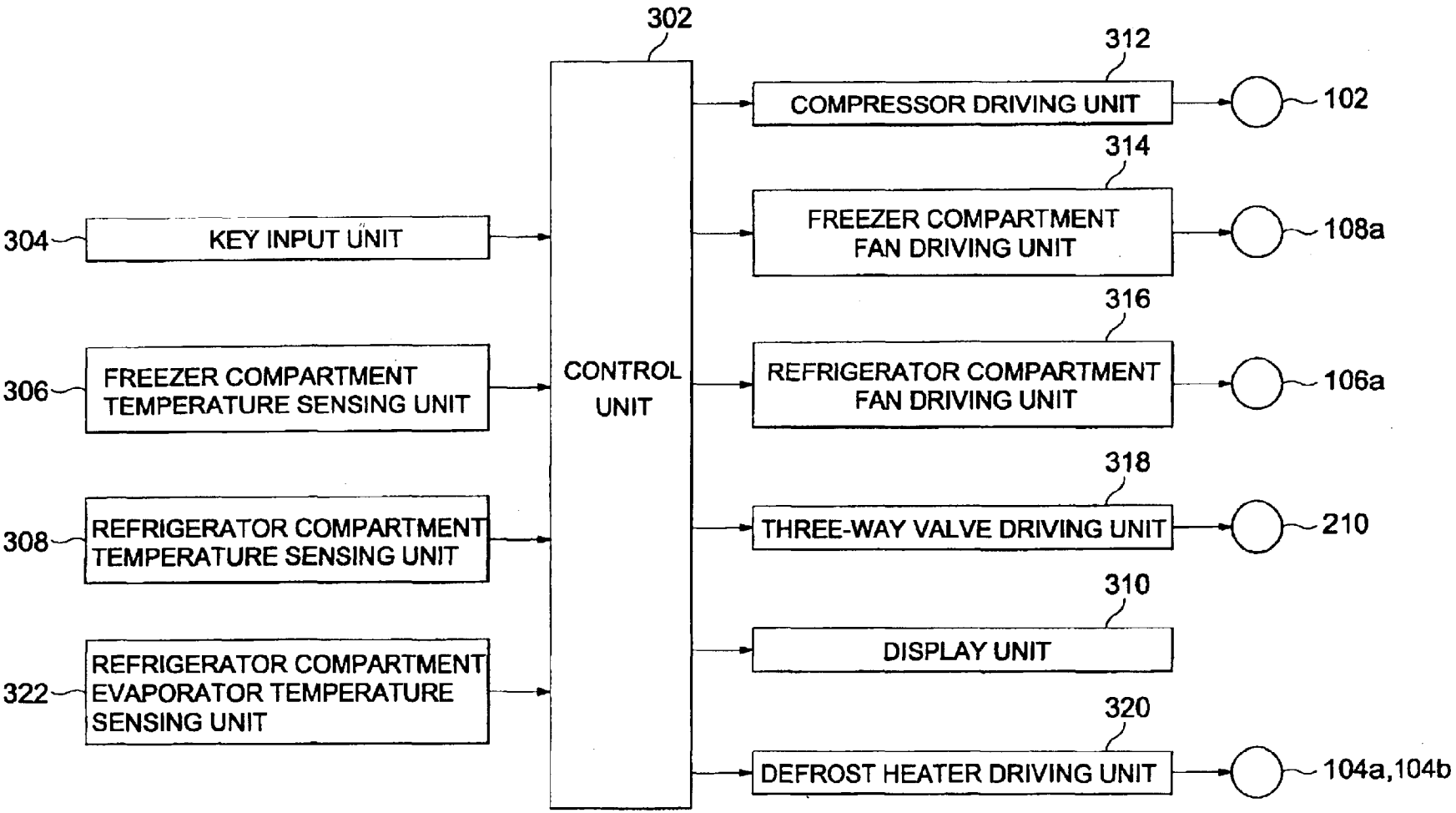
FIG. 3 is a block diagram of a control system implemented on the basis of a control unit of the refrigerator of FIG. 1.
Figure 4:
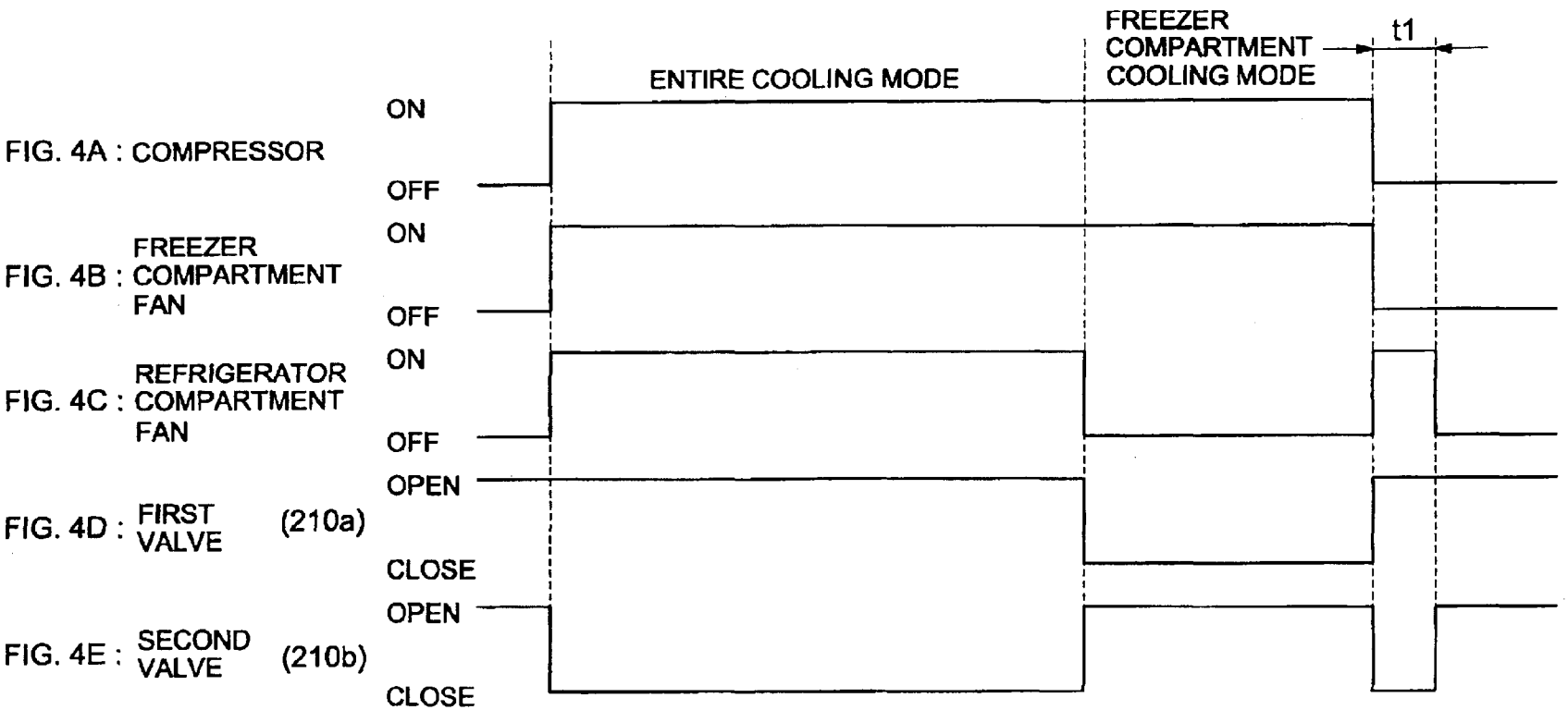
FIGS. 4A–4E include timing charts showing a cooling mode control operation and a passive defrosting control operation of the refrigerator, according to an embodiment of the present invention.
Figure 5:
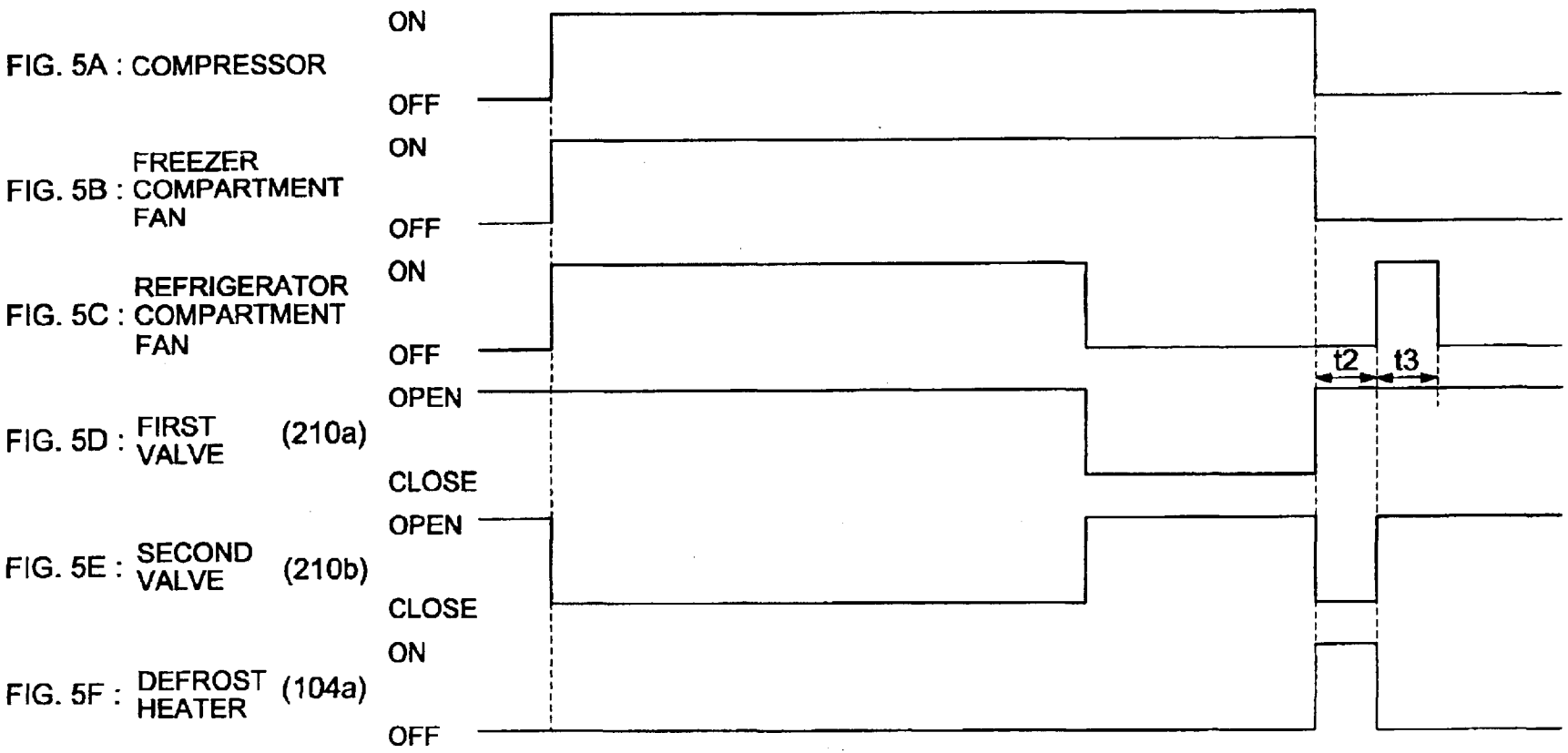
FIGS. 5A–5F include timing charts showing a control operation performed when a temperature surrounding the refrigerator compartment, according to an embodiment of the present invention, is low (for example, equal to or less than 15° C.)

The refrigerator according to an embodiment of the present invention as constructed above provides various cooling modes through the control of a control unit such as a microcomputer. FIG. 3 is a block diagram of a control system implemented on the basis of a control unit 302 provided in the refrigerator according to an embodiment of the present invention. As shown in FIG. 3, an input port of the control unit 302 is connected to a key input unit 304, a freezer compartment temperature sensing unit 306, a refrigerator compartment temperature sensing unit 308, and a refrigerator compartment evaporator temperature sensing unit 322. The key input unit 304 includes a plurality of function keys which relate to the setting of operating conditions of the refrigerator, such as the cooling mode setting and the desired temperature setting. The freezer compartment temperature sensing unit 306 and the refrigerator compartment temperature sensing unit 308 sense the temperatures of the freezer compartment 120 and the refrigerator compartment 110, respectively, and provide the sensed temperatures to the control unit 302. The refrigerator compartment evaporator temperature sensing unit 322 senses a refrigerant evaporation temperature of the refrigerator compartment evaporator 106, and provides the sensed refrigerant evaporation temperature to the control unit 302.

An output port of the control unit 302 is connected to a compressor driving unit 312, a freezer compartment fan driving unit 314, a refrigerator compartment fan driving unit 316, a three-way valve driving unit 318, a defrost heater driving unit 320, and a display unit 310. The driving units 312, 314, 316, 318, and 320 drive the compressor 102, the freezer compartment fan motor 108*a*, the refrigerator compartment fan motor 106*a*, the three-way valve 210 and the defrost heaters 104*a* and 104*b*, respectively. The display unit 310 displays operating states, various set values, and temperatures of the cooling apparatus and the like.

The control unit 302 implements various cooling modes by controlling the three-way valve 210 to circulate the refrigerant through at least one of the two refrigerant circuits of FIG. 2. As two possible representative cooling modes which may be implemented in the refrigerator according to an embodiment of the present invention, a first cooling mode is the entire cooling mode, and a second cooling mode is the freezer compartment cooling mode. The entire cooling mode is an operating mode which allows both the refrigerator compartment 110 and the freezer compartment 120 to be cooled. The control unit 302 opens only a first valve 210*a* of the three-way valve 210 to implement the entire cooling mode, in which refrigerant discharged from the condenser 202 is circulated through the first capillary tube 204, the refrigerator compartment evaporator 106, the second capillary tube 206, and the freezer compartment evaporator 108. The freezer compartment cooling mode is an operating mode which allows only the freezer compartment 120 to be independently cooled. The freezer compartment cooling mode is implemented by allowing the control unit 302 to open only a second valve 210*b* of the three-way valve 210, in which refrigerant discharged from the condenser 202 is circulated through only the third capillary tube 208 and the freezer compartment evaporator 108.

As described below, there are pressure variations of the refrigerant occurring in the entire cooling mode and the freezer compartment cooling mode of the refrigerator according to an embodiment of the present invention, and evaporation temperature variations of the evaporators 106 and 108, depending upon the pressure variation of the refrigerant. If the first valve 210*a* of the three-way valve 210 is opened, as in the entire cooling mode (the second valve 210*b* is closed), refrigerant discharged from the condenser 202 is primarily depressurized by the first capillary tube 204, and primarily evaporated by the refrigerator compartment evaporator 106. The refrigerant, which has been primarily evaporated by the refrigerator compartment evaporator 106, is secondarily depressurized while passing through the second capillary tube 206, and then secondarily evaporated by the freezer compartment evaporator 108.

By the staged depressurization of the refrigerant through the first and second capillary tubes 204 and 206 in the entire cooling mode, unique evaporation temperatures required for the evaporators 106 and 108 may be obtained, so overcooling of the refrigerator compartment evaporator 106, occurring when the evaporation temperature of the refrigerator compartment evaporator 106 is the same as that of the freezer compartment evaporator 108, and the formation of frost, due to the overcooling of the refrigerator compartment evaporator 106, are remarkably decreased.

As described above, a typical suitable temperature of the freezer compartment is approximately −18° C., and a typical suitable temperature of the refrigerator compartment is approximately 3° C. Thus, since the difference between the suitable temperatures of the freezer and refrigerator compartments is large, sufficient cooling of the freezer compartment may not be achieved if the evaporation temperatures of the evaporators are increased to suppress the overcooling of the refrigerator compartment. In the cooling apparatus according to an embodiment of the present invention, if the cooling of the freezer compartment 120 is insufficient, the freezer compartment 120 is independently cooled at a low evaporation temperature, thus enabling the temperature of the freezer compartment 120 to promptly reach a target temperature.

The freezer compartment cooling mode is a mode for allowing only the freezer compartment 120 to be independently cooled. In this mode, the second valve 210*b* of the three-way valve 210 is opened (first valve 210*a* is closed), and refrigerant discharged from the condenser 202 flows into the freezer compartment evaporator 108 through the third capillary tube 208. In the freezer compartment cooling mode, refrigerant is depressurized to a lower pressure by the third capillary tube 208 and then evaporated by the freezer compartment evaporator 108. Through additional depressurization of the refrigerant by the third capillary tube 208, the evaporation temperature of the freezer compartment evaporator 108 becomes lower than that of the refrigerator compartment evaporator 106.

In the refrigerator according to an embodiment of the present invention, even though the evaporation temperatures of the evaporators 106 and 108 are different to minimize the formation of frost, frost may be accumulated on the surface of the refrigerator compartment evaporator 106 due to its operation over a long time. The time division multi-cycle type cooling apparatus of the present invention eliminates the accumulated frost, and provides moisture generated during the frost eliminating process to the refrigerator compartment 110 to increase the humidity of the refrigerator compartment 110 through control operations, which will be described later.

FIGS. 4A–4E include timing charts showing a cooling mode control operation and a passive defrosting control operation of the refrigerator according to an embodiment of the present invention. As shown in FIGS. 4A–4E, in an initial operating state in which the refrigerator, which was turned off, is turned on and supplied with power, the first valve 210*a* is opened and the second valve 210*b* is closed to initially perform the entire cooling mode . After that, the first valve 210*a* is closed, and the second valve 210*b* is opened to perform the freezer compartment cooling mode. Thus, the refrigerator according to an embodiment of the present invention always performs the entire cooling mode first when the refrigerator is supplied with power, and then switches to the freezer compartment cooling mode . If the freezer compartment cooling mode is first performed, the cooling of the refrigerator compartment 110 begins too late, so the entire cooling mode is first performed in consideration of the cooling speed of the refrigerator compartment 110. Alternatively, it is possible to simultaneously perform the entire cooling mode and the freezer compartment cooling mode. However, in this case, while a load of the compressor is greatly increased, the cooling speed is similar to that of the entire cooling mode, so this method is not effective.

When the operation of the compressor 102 is stopped after the freezer compartment cooling mode, the first valve 210*a* of the three-way valve 210 is opened, and the second valve 210*b* is closed, for a time t1 shown in FIGS. 4A–4E. After the time t1 has elapsed, the second valve 210*b* is opened again. In the freezer compartment cooling mode, the refrigerator compartment evaporator 106 has almost a vacuum state, which is free of refrigerant. Therefore, if the first valve 210*a* is opened after the operation of the compressor 102 is stopped, high temperature refrigerant which has been previously compressed and discharged by the compressor 102 flows into the refrigerator compartment evaporator 106 having almost a vacuum state therein. As a result, the refrigerant flowing into the refrigerator compartment evaporator 106 is depressurized to some degree by the first capillary tube 204 for the certain time t1 immediately after the operation of the compressor 102 is stopped, thus decreasing the refrigerant evaporation temperature of the refrigerator compartment evaporator 106. If the refrigerator compartment fan 106*b* is operated for the time t1, the cooling of the refrigerator compartment 110 may be additionally performed.

However, if the temperature surrounding the refrigerator compartment is less than a preset temperature (for example, 15° C.) at the time the entire cooling mode is completed, the temperature of the refrigerator compartment 110 may still be decreased to be equal to or less than a target temperature. FIGS. 5A–5F include timing charts showing a control operation performed when the temperature surrounding the refrigerator compartment according to an embodiment of the present invention is low (for example, equal to or less than 15° C.). As shown in FIGS. 5A–5F, if the temperature surrounding the refrigerator compartment is less than the preset temperature (for example, equal to or less than 15° C.) when the operation of the compressor 102 is stopped after the freezer compartment cooling mode, the defrost heater 104*a* of the refrigerator compartment evaporator 106 is operated for a first preset time t2 after the first valve 210*a* is opened and the second valve 210*b* is closed. In this case, even though the temperature surrounding the refrigerator compartment has decreased to be equal to or less than 0° C., the target temperature of the refrigerator compartment 110 may be maintained. At this time, a heating temperature of the defrost heater 104*a* is limited to a preset temperature or less of the refrigerator compartment 110, thus preventing the temperature of the refrigerator compartment 110 from exceeding the target temperature due to heating by the defrost heater 104*a*. After that, if the time t2 has elapsed, the second valve 210*b* is opened again to stop the operation of the defrost heater 104*a*, and thereafter the refrigerator compartment fan 106*b* is operated for a time t3. In this case, the reason for closing the second valve 210*b* and then opening it again is to equalize the pressure of the refrigerant over the entire refrigerant circuits by opening both the first and second valves 210*a* and 210*b*.

Figure 6:
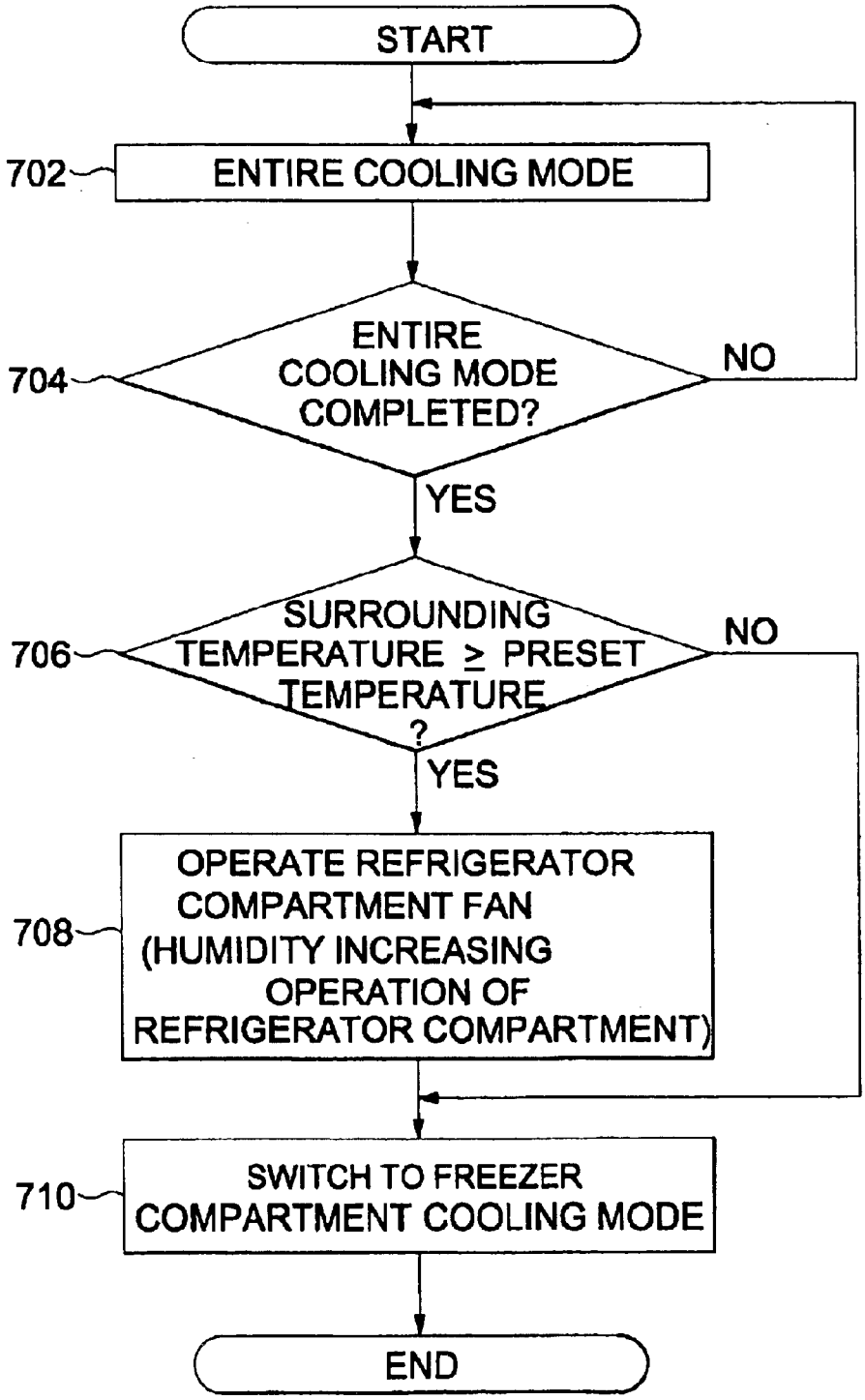
FIG. 6 is a flowchart showing a humidity increase operating method of a refrigerator compartment when a temperature surrounding the refrigerator compartment, according to an embodiment of the present invention, is high.

In the refrigerator according to an embodiment of the present invention, if the temperature surrounding the refrigerator compartment is equal to or greater than a certain temperature (for example, 15° C.) when the entire cooling mode has been completed, there is performed a humidity increasing operation to eliminate frost formed on the refrigerator compartment evaporator 106. The moisture generated at the time of eliminating the frost is simultaneously blown into the refrigerator compartment 110, to increase the humidity of the refrigerator compartment 110, by operating the refrigerator compartment fan 106*b* for a certain time. However, if the humidity increasing operation of the refrigerator compartment 110 is performed when the temperature surrounding the refrigerator compartment is excessively low, dew condensation forms in the refrigerator compartment 110, so the humidity increasing operation is performed only when the temperature surrounding the refrigerator compartment is equal to or greater than a certain temperature. FIG. 6 is a flowchart of a humidity increasing operating method of the refrigerator compartment performed when the temperature surrounding the refrigerator compartment according to an embodiment of the present invention is high. As shown in FIG. 6, if the entire cooling mode has been completed in 702 and 704, it is determined whether the temperature surrounding the refrigerator compartment is equal to or greater than a preset temperature in 706. If it is determined that the temperature surrounding the refrigerator compartment is equal to or greater than the preset temperature, the refrigerator compartment fan 106*b* is operated for a certain time to perform the humidity increasing operation of the refrigerator compartment 110 in 708, and thereafter an operating mode is switched to the freezer compartment cooling mode in 710.

Figure 7:
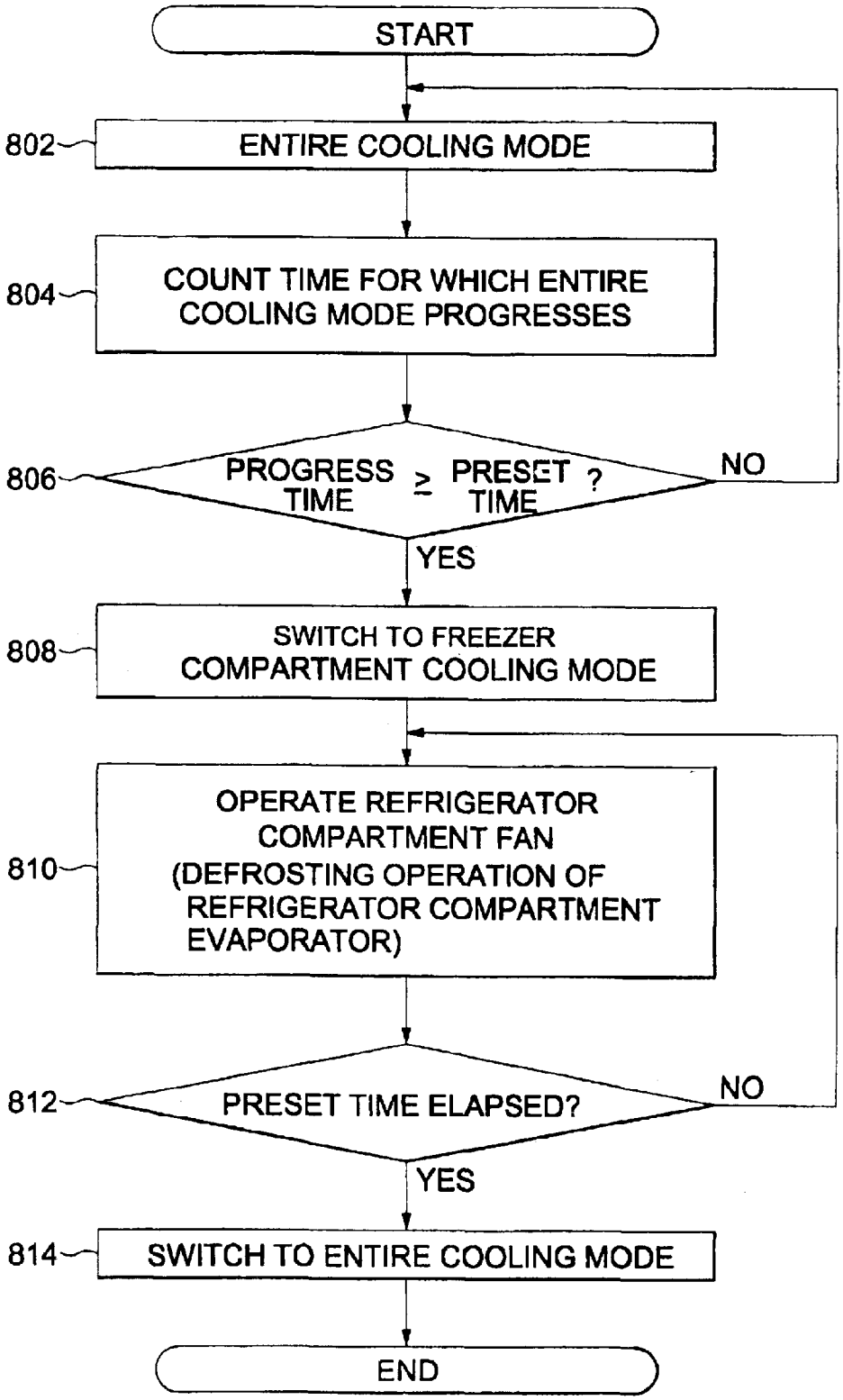
FIG. 7 is a flowchart showing a defrosting method of a refrigerator compartment evaporator depending on an operating time of an entire cooling mode in the refrigerator, according to an embodiment of the present invention.

If the cooling load of the refrigerator compartment 110 is continuously increased due to frequent opening of a door, etc., in the entire cooling mode, in which both the refrigerator compartment 110 and the freezer compartment 120 are cooled, the operating time of the entire cooling mode is inevitably lengthened so as to maintain a target temperature of the refrigerator compartment 110. If the operating time of the entire cooling mode is excessively long, frost formed on the surface of the refrigerator compartment evaporator 106 is accumulated, greatly deteriorating cooling efficiency of the refrigerator compartment 110. Therefore, if a continuous operating time of the entire cooling mode is increased to be equal to or greater than a preset time, the refrigerator compartment fan 106*b* is operated to perform a defrosting operation of the refrigerator compartment evaporator 106. FIG. 7 is a flowchart of a defrosting method of the refrigerator compartment evaporator depending on the operating time of the entire cooling mode in the refrigerator according to an embodiment of the present invention. As shown in FIG. 7, the time for which the entire cooling mode progresses is counted while the entire cooling mode is performed in 802 and 804 (using a counter provided in the control unit). If the progress time of the entire cooling mode is equal to or greater than a preset time in 806, the operating mode is switched from the entire cooling mode to the freezer compartment cooling mode in 808. Thereafter, the refrigerator compartment fan 106*b* is operated to perform a defrosting operation of the refrigerator compartment evaporator 106 in 810. If the operating time of the refrigerator compartment fan 106*b* exceeds a preset time in 812, the operating mode is switched again from the freezer compartment cooling mode to the entire cooling mode to perform a cooling operation in 814.

FIGS. 8A–8H include timing charts showing a defrosting control operation of the refrigerator compartment evaporator 106 and the freezer compartment evaporator 108, with restart of the compressor taken into consideration, in the refrigerator according to an embodiment of the present invention. Simultaneous defrosting operations of the refrigerator compartment evaporator 106 and the freezer compartment evaporator 108, performed during an idle period of the compressor 102, are carried out by operating the defrost heaters 104*a* and 104*b*, respectively provided in the evaporators 106 and 108, after the operations of the compressor 102 and the fans 106*b* and 108*b* are stopped, and both the first and second valves 210*a* and 210*b* of the three-way valve 210 are opened. During this simultaneous defrosting process, the pressure of the refrigerant is increased due to the heating by the defrost heaters 104*a* and 104*b*. In this case, if the pressure of the refrigerant is excessively high, re-starting of the compressor 102 is not performed smoothly after the defrosting operation has been completed. Therefore, as shown in FIGS. 8A–8H, the defrost heaters 104*a* and 104*b*, respectively provided in the evaporators 106 and 108, are operated to eliminate formed frost. After the operations of the defrost heaters 104*a* and 104*b* have been completed, the condenser fan 202*b* and the freezer compartment fan 108*b* are operated for a certain time to decrease the temperature of the refrigerant heated by the defrost heaters 104*a* and 104*b*, thus decreasing the pressure of the refrigerant. In this way, the pressure of the refrigerant is decreased to enable the re-starting of the compressor 102 to be performed more smoothly. While the defrost heaters 104*a* and 104*b* are operated, the condenser fan 202*b* and the freezer compartment fan 108*b* are not operated, so as to increase heating effect of the defrost heaters 104*a* and 104*b*.

FIGS. 9A–9F include timing charts showing a control method performed when only the freezer compartment evaporator is independently defrosted during an idle period of the compressor in the refrigerator according to an embodiment of the present invention. As shown in FIGS. 9A-9F, the independent defrosting operation of only the freezer compartment evaporator 108 is performed when the first valve 210*a* of the three-way valve 210 is closed and the second valve 210*b* is opened, after the compressor 102 and the evaporator fans 106*b* and 108*b* have been stopped. If the second valve 210*b* is opened, high temperature refrigerant of the condenser 202 flows into the freezer compartment evaporator 108 through the third capillary tube 208 to increase the temperature. In this case, the load of the defrost heater 104*b* of the freezer compartment 120 is decreased, thus reducing power consumption due to the operation of the defrost heater 104*b*. After the defrosting operation of the freezer compartment evaporator 108 has been completed, both the first and second valves 210*a* and 210*b* of the three-way valve 210 are opened for a certain time t5 to equalize the pressure of refrigerant over the respective refrigerant circuits before the compressor 102 is re-started. If the time t5 has elapsed and the pressure equalization of the refrigerant circuits is achieved in some degree, the compressor 102 is re-started.

As is apparent from the above description, the present invention provides a time division multi-cycle type cooling apparatus and method for controlling the same, which has the following advantages. First, in the case of a refrigerator, a refrigerator compartment and a freezer compartment are cooled at different evaporation temperatures, or only the freezer compartment is independently cooled, thus obtaining cooling temperatures suitable for the refrigerator and freezer compartments, respectively, and suppressing overcooling of the refrigerator compartment. Further, the present invention may perform a defrosting operation of a refrigerator compartment evaporator by operating a refrigerator compartment fan and (or additionally) a defrost heater in an operating mode in which only the freezer compartment is independently cooled, and increase the humidity of the refrigerator compartment by blowing moisture generated during a defrosting process into the refrigerator compartment. Further, in an embodiment of the present invention, a refrigerator compartment fan is operated for a certain time to eliminate frost formed on the surface of the refrigerator compartment evaporator immediately after the operation of the compressor is stopped, thus solving a frost formation problem occurring due to the evaporation of refrigerant in the refrigerator compartment evaporator immediately after the compressor is stopped.

In addition, in the case of an air conditioner system having a plurality of indoor units, different evaporation temperatures are assigned to indoor units requiring different cooling capacities, thus achieving effective air conditioning.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A cooling apparatus, comprising:

a compressor, a condenser, a first expanding unit, a second expanding unit, a third expanding unit, a first evaporator, and a second evaporator;

a first refrigerant circuit containing refrigerant discharged from the compressor and flowing into a suction side of the compressor through the condenser, the first expanding unit, the first evaporator, the second expanding unit and the second evaporator;

a second refrigerant circuit containing the refrigerant passing through the condenser and flowing into the suction side of the compressor through the third expanding unit and the second evaporator, bypassing the first expanding unit, the first evaporator, and the second expanding unit;

a flow path control unit installed at a discharge side of the condenser, switching a refrigerant flow path so that the refrigerant passing through the condenser flows through at least one of the first and second refrigerant circuits; and a control unit selectively opening and closing the flow path control unit.

2. The cooling apparatus according to claim 1, wherein the control unit generates:

a first cooling mode obtaining two different evaporation temperatures from the first and second evaporators through independent expansion of the refrigerant in the first and second expanding units by controlling the flow path control unit to allow the refrigerant to flow through the first refrigerant circuit; and a second cooling mode obtaining a single evaporation temperature from the second evaporator through expansion of the refrigerant in the third expanding unit by controlling the flow path control unit to allow the refrigerant to flow through the second refrigerant circuit.

3. The cooling apparatus according to claim 1, wherein the second and third expanding units are constructed so that a depressurization of the refrigerant performed by the second and third expanding units is sufficient to obtain an evaporation temperature required for the second evaporator.

4. The cooling apparatus according to claim 1, wherein at least one of the first, second, and third expanding units is a capillary tube.

5. The cooling apparatus according to claim 1, wherein the second expanding unit is constructed so that an inside diameter thereof is less than that of a refrigerant pipe disposed at the suction side of the compressor.

6. The cooling apparatus according to claim 5, wherein the inside diameter of the second expanding unit is 2 to 4 mm.

7. The cooling apparatus according to claim 1, wherein the control unit is a microprocessor.

8. A method of controlling a cooling apparatus, the cooling apparatus comprising a first refrigerant circuit containing refrigerant discharged from a compressor flowing into a suction side of the compressor through a condenser, a first expanding unit, a first evaporator, a second expanding unit and a second evaporator, a second refrigerant circuit containing the refrigerant passing through the condenser flowing into the suction side of the compressor through a third expanding unit and the second evaporator, bypassing the first expanding unit, the first evaporator, and the second expanding unit, a flow path control unit installed at a discharge side of the condenser switching a refrigerant flow path so that the refrigerant passing through the condenser flows through at least one of the first and second refrigerant circuits, a control unit selectively opening and closing the flow path control unit, a first cooling compartment cooled by the first evaporator, and a second cooling compartment cooled by the second evaporator, the method comprising:

cooling both the first and second cooling compartments by controlling the flow path control unit to allow the refrigerant to flow through the first refrigerant circuit; and independently cooling the second cooling compartment by controlling the flow path control unit to allow the refrigerant to flow through the second refrigerant circuit in response to a temperature of the first cooling compartment reaching a target temperature.

9. The cooling apparatus control method according to claim 8, further comprising stopping an operation of the compressor in response to a temperature of the second cooling compartment reaching a target temperature.

10. The cooling apparatus control method according to claim 9, further comprising supplying compressed refrigerant, which has been previously discharged by the compressor, to the first refrigerant circuit by controlling the flow path control unit to close the second refrigerant circuit and open the first refrigerant circuit in response to the operation of the compressor being stopped.

11. The cooling apparatus control method according to claim 10, wherein the cooling apparatus further comprises a first evaporator fan to blow air surrounding the first evaporator into the first cooling compartment, the control method further comprising:

eliminating frost formed on a surface of the first evaporator by operating the first evaporator fan for a first predetermined time if a temperature of the first cooling compartment is equal to or less than a predetermined temperature after the first refrigerant circuit is opened.

12. The cooling apparatus control method according to claim 11, further comprising opening both the first and second refrigerant circuits in response to the first predetermined time elapsing, thus equalizing pressure of the refrigerant over the entire first and second refrigerant circuits.

13. The cooling apparatus control method according to claim 10, wherein the cooling apparatus further comprises a first defrost heater to eliminate frost formed on a surface of the first evaporator, a first evaporator fan to blow air surrounding the first evaporator into the first cooling compartment, and a second evaporator fan to blow air surrounding the second evaporator into the second cooling compartment, the control method further comprising:

preventing the temperature of the first cooling compartment from decreasing to be equal to or less than the target temperature due to an external temperature of the cooling apparatus by operating the first defrost heater for a first predetermined time if the external temperature is equal to or less than a predetermined temperature after the first refrigerant circuit is opened.

14. The cooling apparatus control method according to claim 13, wherein the predetermined temperature is 15° C.

15. The cooling apparatus control method according to claim 13, wherein the first defrost heater is operated so that a heating temperature thereof is limited to the target temperature or less of the first cooling compartment, thus preventing the temperature of the first cooling compartment from exceeding the target temperature.

16. The cooling apparatus control method according to claim 13, further comprising opening both the first and second refrigerant circuits in response to the first predetermined time elapsing, thus equalizing pressure of the refrigerant over the entire first and second refrigerant circuits.

17. The cooling apparatus control method according to claim 13, wherein the cooling apparatus further comprises a second defrost heater to eliminate frost formed on a surface of the second evaporator and a condenser fan provided in the condenser, the control method further comprising:

opening both the first and second refrigerant circuits by controlling the flow path control unit, and operating the first and second defrost heaters to perform a simultaneous defrosting operation in response to frost being formed on surfaces of both the first and second evaporators after the compressor has been stopped.

18. The cooling apparatus control method according to claim 17, wherein the control method further comprises decreasing pressure of the refrigerant, which has been increased due to the first and second defrost heaters, to smoothly restart the compressor by operating the first and second evaporator fans and the condenser fan in response to the defrosting operation having been completed and the first and second defrost heaters having been stopped.

19. The cooling apparatus control method according to claim 17, wherein the first and second evaporator fans are not operated while the first and second defrost heaters are operated.

20. The cooling apparatus control method according to claim 9, further comprising operating a second defrost heater while heated refrigerant of the condenser flows into the second evaporator by closing the first refrigerant circuit and opening the second refrigerant circuit in response to frost being formed on a surface of the second evaporator after the compressor has been stopped.

21. The cooling apparatus control method according to claim 20, further comprising opening both the first and second refrigerant circuits to equalize pressure of the refrigerant over the entire first and second refrigerant circuits in response to the independent defrosting operation of the second evaporator having been completed.

22. The cooling apparatus control method according to claim 8, wherein the flow path control unit is operated to allow the refrigerant to flow through the first refrigerant circuit if the cooling apparatus is turned on to be supplied with power, and then allow the refrigerant to flow through the second refrigerant circuit if a cooling operation through the first refrigerant circuit has been completed.

23. The cooling apparatus control method according to claim 8, further comprising:

eliminating frost formed on a surface of the first evaporator by operating a first evaporator fan for a second predetermined time in response an external temperature of the cooling apparatus being equal to or greater than a predetermined temperature when the first refrigerant circuit is closed; and simultaneously increasing humidity of the first cooling compartment by blowing moisture generated during elimination of frost into the first cooling compartment by operating the first evaporator fan.

24. The cooling apparatus control method according to claim 23, wherein the predetermined temperature is 15° C.

25. The cooling apparatus control method according to claim 8, further comprising:

closing the first refrigerant circuit and opening the second refrigerant circuit in response a cooling time through the first refrigerant circuit being equal to or greater than a first predetermined time during which the temperature of the first cooling compartment does not reach the target temperature;

eliminating frost formed on a surface of the first evaporator by operating a first evaporator fan for a second predetermined time; and re-starting a cooling operation through the first refrigerant circuit by closing the second refrigerant circuit and opening the first refrigerant circuit again after the second predetermined time has elapsed.

26. A cooling system comprising:

a compressor, a condenser, a first expanding unit, a second expanding unit, a third expanding unit, a first evaporator, and a second evaporator;

a first refrigerant circuit containing refrigerant discharged from the compressor and flowing into a suction side of the compressor through the condenser, the first expanding unit, the first evaporator, the second expanding unit and the second evaporator;

a second refrigerant circuit containing the refrigerant passing through the condenser flowing into the suction side of the compressor through the third expanding unit and the second evaporator, by passing the first expanding unit, the first evaporator, and the second expanding unit; and a flow path control unit installed at a discharge side of the condenser, switching a refrigerant flow path so that the refrigerant passing through the condenser flows through at least one of the first and second refrigerant circuits.

27. The cooling system of claim 26, further comprising a control unit selectively opening and closing the flow path control unit.

28. The cooling system of claim 27, wherein the control unit is a microprocessor.

* * * * *